US010303085B2

(12) United States Patent
Sato et al.

(10) Patent No.: US 10,303,085 B2
(45) Date of Patent: May 28, 2019

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Taichi Sato, Numazu (JP); Jumpei Kuno, Yokohama (JP); Kenichi Kaku, Suntou-gun (JP); Takashi Anezaki, Hiratsuka (JP); Atsushi Fujii, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/992,605

(22) Filed: May 30, 2018

(65) Prior Publication Data

US 2018/0348665 A1 Dec. 6, 2018

(30) Foreign Application Priority Data

Jun. 6, 2017 (JP) ..... 2017-111664

(51) Int. Cl.

| | |
|---|---|
| ***G03G 5/00*** | (2006.01) |
| ***G03G 15/08*** | (2006.01) |
| ***G03G 15/16*** | (2006.01) |
| ***G03G 15/18*** | (2006.01) |
| ***G03G 15/02*** | (2006.01) |

(Continued)

(52) U.S. Cl.

CPC ..... *G03G 15/0865* (2013.01); *G03G 5/104* (2013.01); *G03G 5/144* (2013.01); *G03G 15/02* (2013.01); *G03G 15/16* (2013.01); *G03G 15/18* (2013.01)

(58) Field of Classification Search

USPC ..... 430/63

See application file for complete search history.

(56) References Cited

U.S. PATENT DOCUMENTS

| | | | |
|---|---|---|---|
| 6,773,856 | B2 | 8/2004 | Tanaka et al. |
| 6,994,941 | B2 | 2/2006 | Tanaka et al. |

(Continued)

FOREIGN PATENT DOCUMENTS

| | | |
|---|---|---|
| DE | 19847696 | 4/1999 |
| JP | 2002-296819 | 10/2002 |

(Continued)

OTHER PUBLICATIONS

U.S. Appl. No. 15/895,148, Jumpei Kuno, filed Feb. 13, 2018.
U.S. Appl. No. 15/901,128, Jumpei Kuno, filed Feb. 21, 2018.

*Primary Examiner* — Mark A Chapman
(74) *Attorney, Agent, or Firm* — Venable LLP

(57) ABSTRACT

Provided is an electrophotographic photosensitive member capable of achieving both high leak resistance and reduction in variations in dark part potential and bright part potential due to repeated use even when CB is used for an electrically conductive layer. An electrophotographic photosensitive member including: a support, an electrically conductive layer, and a photosensitive layer, sequentially, wherein the electrically conductive layer contains a binder resin and carbon black, a number average primary particle diameter of the carbon black is 200 nm or more and 500 nm or less, an average inter-particle distance of the carbon black is 200 nm or more and 600 nm or less, a coefficient of variation of an inter-particle distance is 1.2 or less, and SF-1 of the carbon black is 150 or less.

7 Claims, 5 Drawing Sheets

(51) Int. Cl.
*G03G 5/10* (2006.01)
*G03G 5/14* (2006.01)

(56) References Cited

U.S. PATENT DOCUMENTS

| | | | |
|---|---|---|---|
| 7,045,261 | B2 | 5/2006 | Tanaka et al. |
| 7,245,851 | B2 | 7/2007 | Fujii et al. |
| 7,333,752 | B2 | 2/2008 | Kawahara et al. |
| 7,517,626 | B2 | 4/2009 | Fujii et al. |
| 7,556,901 | B2 | 7/2009 | Anezaki et al. |
| 7,910,274 | B2 | 3/2011 | Tanaka et al. |
| 7,927,774 | B2 | 4/2011 | Ogaki et al. |
| 8,088,541 | B2 | 1/2012 | Tanaka et al. |
| 8,455,170 | B2 | 6/2013 | Nakamura et al. |
| 8,538,298 | B2 | 9/2013 | Harada et al. |
| 8,669,027 | B2 | 3/2014 | Anezaki et al. |
| 8,753,789 | B2 | 6/2014 | Ogaki et al. |
| 8,778,580 | B2 | 7/2014 | Tsuji et al. |
| 8,783,209 | B2 | 7/2014 | Kaku et al. |
| 8,921,020 | B2 | 12/2014 | Murai et al. |
| 8,980,508 | B2 | 3/2015 | Okuda et al. |
| 8,980,509 | B2 | 3/2015 | Noguchi et al. |
| 8,980,510 | B2 | 3/2015 | Fujii et al. |
| 9,029,054 | B2 | 5/2015 | Okuda et al. |
| 9,040,214 | B2 | 5/2015 | Fujii et al. |
| 9,046,797 | B2 | 6/2015 | Fujii et al. |
| 9,063,505 | B2 | 6/2015 | Sekiya et al. |
| 9,069,267 | B2 | 6/2015 | Kaku et al. |
| 9,075,333 | B2 | 7/2015 | Uematsu et al. |
| 9,098,006 | B2 | 8/2015 | Uematsu et al. |
| 9,158,213 | B2 | 10/2015 | Taniguchi et al. |
| 9,164,406 | B2 | 10/2015 | Nishi et al. |
| 9,188,888 | B2 | 11/2015 | Okuda et al. |
| 9,256,145 | B2 | 2/2016 | Fujii et al. |
| 9,256,153 | B2 | 2/2016 | Aoyama et al. |
| 9,274,442 | B2 | 3/2016 | Sato et al. |
| 9,372,417 | B2 | 6/2016 | Fujii et al. |
| 9,372,418 | B2 | 6/2016 | Shida et al. |
| 9,372,419 | B2 | 6/2016 | Tsuji et al. |
| 9,448,502 | B2 | 9/2016 | Taniguchi et al. |
| 9,523,929 | B2 | 12/2016 | Nakamura et al. |
| 9,563,139 | B2 | 2/2017 | Kawahara et al. |
| 9,599,914 | B2 | 3/2017 | Uematsu et al. |
| 9,599,915 | B2 | 3/2017 | Anezaki et al. |
| 9,599,917 | B2 | 3/2017 | Okuda et al. |
| 9,645,516 | B2 | 5/2017 | Kawahara et al. |
| 9,645,517 | B2 | 5/2017 | Sato et al. |
| 9,726,992 | B2 | 8/2017 | Sakuma et al. |
| 9,851,646 | B2 | 12/2017 | Tomono et al. |
| 9,869,032 | B2 | 1/2018 | Kawahara et al. |
| 2012/0076539 | A1 | 3/2012 | Sato et al. |
| 2014/0004450 | A1 | 1/2014 | Tokimitsu et al. |
| 2015/0346617 | A1 | 12/2015 | Kawahara et al. |
| 2015/0362847 | A1 | 12/2015 | Tanaka et al. |
| 2018/0024460 | A1 | 1/2018 | Uematsu et al. |

FOREIGN PATENT DOCUMENTS

| | | | |
|---|---|---|---|
| JP | 2002-311629 | A | 10/2002 |
| JP | 2004-093640 | | 3/2004 |

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, and a process cartridge and an electrophotographic apparatus including the electrophotographic photosensitive member.

Description of the Related Art

Recently, research and development of an electrophotographic photosensitive member (organic electrophotographic photosensitive member) using an organic photoconductive material have been actively conducted.

The electrophotographic photosensitive member is basically comprised of a support; and a photosensitive layer formed on the support. However, in the current state, there are a number of cases in which various layers are provided between a support and a photosensitive layer for purposes of concealing surface defects of the support, protecting the photosensitive layer against electrical breakdown, improving chargeability, and improving charge injection stability from the support to the photosensitive layer.

Among the layers provided between the support and the photosensitive layer, an electrically conductive layer conceals surface defects of the support, thereby expanding an allowable range of the surface defects of the support. As a result, the allowable range of use of the support is greatly expanded, and thus there is an advantage that productivity of the electrophotographic photosensitive member can be improved. In addition, carbon black (hereinafter, abbreviated as CB in some cases) in the electrically conductive layer can be easily formed to have low resistance of the electrically conductive layer, and thus an increase in residual potential during image formation hardly occurs, and variations in dark part potential and bright part potential hardly occur.

Japanese Patent Application Laid-Open No. 2002-311629 discloses an electrophotographic photosensitive member containing CB in an electrically conductive layer.

In addition, in recent years, a high-definition of an output image by electrophotography is underway. It is known that the high-definition of the output image is effective by a high contrast of thinning the photosensitive layer or increasing an absolute value of a charging potential (Vd potential) of the photosensitive layer (high Vd potential).

SUMMARY OF THE INVENTION

An electrophotographic photosensitive member according to one aspect of the present invention includes: a support, an electrically conductive layer, and a photosensitive layer, sequentially, wherein the electrically conductive layer contains a binder resin and a carbon black, a number average primary particle diameter of the carbon black is 200 nm or more and 500 nm or less, an average inter-particle distance of the carbon black is 200 nm or more and 600 nm or less, a coefficient of variation of an inter-particle distance is 1.2 or less, and SF-1 of the carbon black is 150 or less.

In addition, the present invention relates to a process cartridge being detachably attachable to an electrophotographic apparatus main body, the process cartridge including an electrophotographic photosensitive member; and at least one unit that are integrally supported, the at least one unit being selected from the group consisting of a charging unit, a developing unit, a transfer unit, and a cleaning unit.

In addition, the present invention relates to an electrophotographic apparatus including the electrophotographic photosensitive member; a charging unit, an exposing unit, a developing unit, and a transfer unit.

Further features of the present invention will become apparent from the following description of exemplary embodiments with reference to the attached drawings.

DESCRIPTION OF THE EMBODIMENTS

Figure 1:
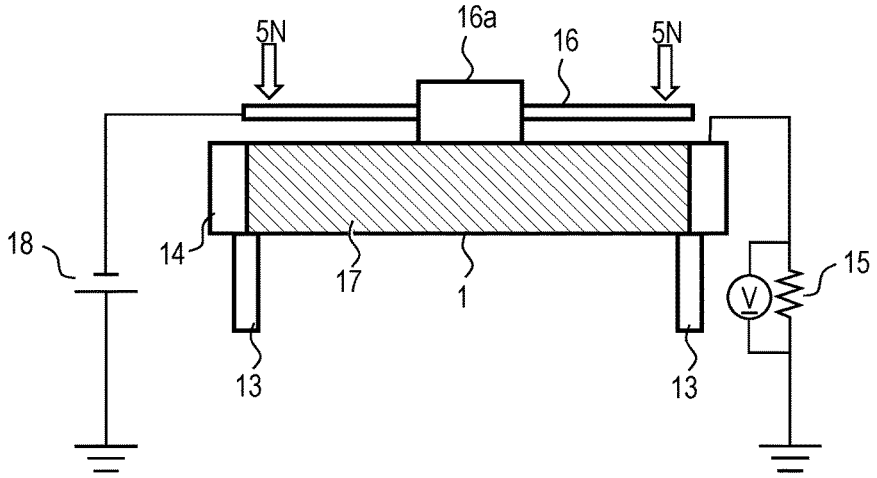
FIG. 1 is a view schematically illustrating a static leak test apparatus.

Preferred embodiments of the present invention will now be described in detail in accordance with the accompanying drawings.

According to review by the present inventors, an electrophotographic photosensitive member disclosed in Japanese Patent Application Laid-Open No. 2002-311629 is superior in suppressing variations in dark part potential and bright part potential due to repeated use, but has a problem of leak in which an insulation breakdown of a photosensitive layer is caused with respect to thinning of a photosensitive layer or high Vd potential.

An aspect of the present invention is to provide an electrophotographic photosensitive member capable of achieving both high leak resistance and reduction in variations in dark part potential and bright part potential due to repeated use.

Hereinafter, the present invention is described in detail with reference to preferred embodiments.

As a result of review conducted by the present inventors, it was found that a technique described in Japanese Patent Application Laid-Open No. 2002-311629 could not form an electrically conductive layer having appropriate electrical resistance and had low leak resistance.

It can be appreciated in a constitution of the technique described in Japanese Patent Application Laid-Open No. 2002-311629 that time until reaching the leak is short, and leak resistance time in a static leak test and tendency of leak frequency by a real machine match well. The leak resistance time is defined as a time until reaching a leak after a voltage is applied.

In order to solve problems of the technique described in the above-described Japanese Patent Application Laid-Open No. 2002-311629, the present inventors conducted a review while being focused on a CB used for the electrically conductive layer, particularly a shape and dispersion degree of the CB.

As a result of the above review, it can be appreciated that the above problem can be solved by using an electrophotographic photosensitive member in which, a number average primary particle diameter of the carbon black (CB) is 200 nm or more and 500 nm or less, an average inter-particle distance of the CB in an electrically conductive layer is 200 nm or more and 600 nm or less, a coefficient of variation of an inter-particle distance of the CB is 1.2 or less, and SF-1 of the carbon black is 150 or less. Here, SF-1 is defined by the following equation (1).

[Equation 1]

$$SF-1=\frac{(L/2)^2\times\pi}{CB\text{ cross-sectional area}}\times 100 \quad (1)$$

L in the Equation (1) is a maximum length of a CB cross section. In other words, SF-1 represents a ratio of a circle area having a maximum length L of the CB cross section as a diameter to a CB cross-sectional area as a percentage, and is a shape factor indicating circularity. A value of SF-1 is closer to 100 as a shape is closer to a perfect circle, and is larger as the shape is thinner and longer, and thus, in other words, the value of SF-1 represents a difference (variation) between a long diameter/short diameter of the CB. When the value of SF-1 is 150 or less, it means that the shape of the CB in the cross section of the electrically conductive layer is a substantially spherical shape close to a circle.

The reason why the leak resistance is greatly improved by the above-described constitution is considered to be due to an estimation mechanism shown below.

As a result of review conducted by the present inventors, it can be appreciated that when the electrically conductive layer is the same in the above-described static leak test, leak resistance time decreases exponentially with respect to an electric field intensity applied to the photosensitive layer. Further, it is considered that voltage applied to the photosensitive layer exceeds a insulation breakdown voltage, leading to leak of the photosensitive layer. That is, when a predetermined level or more of the electric field intensity is applied to the photosensitive layer, the photosensitive layer deteriorates (lowers a insulation breakdown voltage) to reach the leak, wherein it is considered that a degree of deterioration of the photosensitive layer increases exponentially with respect to the electric field intensity applied to the photosensitive layer.

The electrically conductive layer of the electrophotographic photosensitive member secures electrical conductivity by dispersing conductive particles in an insulating resin, and exhibits electrical conductivity by an electronic conductive mechanism. The electronic conductive mechanism is a mechanism in which conductive particles dispersed in the insulating resin form a conductive path to flow electricity, as generally explained in a percolation model. When the CB is used as the conductive particle, since a volume resistance value of CB is low, it is expected that there is a localized portion in which a volume resistance value is appropriate as the electrically conductive layer in view of a macroscopic aspect, but is very low in view of a microscopic aspect. Therefore, it is considered that the above-described photosensitive layer has a deteriorated electric field intensity at a localized portion, and thus the leak resistance is low.

Accordingly, it is considered that when an electrically conductive agent having a low volume resistivity such as CB is used, particularly, it is necessary to constitute so that the electric field is not concentrated even locally. That is, it is considered that it is important to disperse the CB having the number average primary particle diameter of 200 nm or more and 500 nm or less so that an average inter-particle distance is 200 nm or more and 600 nm or less, a coefficient of variation of an inter-particle distance of the CB is 1.2 or less, and SF-1 of the CB is 150 or less.

The CB according to an embodiment of the present invention is characterized in that SF-1 is 150 or less as described above. SF-1 is determined in the cross section of the electrically conductive layer and there is no point that the electric field is concentrated in the CB itself having a low volume resistance value by the shape in which the SF-1 is in the above-described range, that is, close to the circular shape, and thus the electric field intensity does not locally increase well. However, when CB having a low volume resistance value is agglomerated, it can be regarded as one conductor. Therefore, when determining SF-1, it is not determined by using primary particles of CB, but it is necessary to determine the SF-1 by using an aggregate as one conductor.

Further, in order to accurately evaluate electric field concentration caused by the shape of the conductor, it is considered that three-dimensional analysis is required to be conducted. That is, when confirming the aggregate of the CB on the cross section of the electrically conductive layer, even if the CB is actually three-dimensionally agglomerated, there are some cases that the CB is observed as if the CB is present as a primary particle according to a method of taking the cross section. However, since an average value of a plurality of CBs that can be confirmed on the cross section is calculated for the determination of the SF-1, it is considered that even if a part of the aggregate is shown as the primary particle of the CB, there is almost no influence on the value of SF-1. In addition, even though all CBs on the cross section are shown as primary particles, there are some cases that the agglomerated CBs are mixed in three-dimensions. In this case as well, from the viewpoint of calculating the SF-1 from a large number of CBs, the number of agglomeration that cannot be observed on the cross section has a small influence on the leak, and thus evaluation from the cross section is actually sufficient.

In addition, the CB according to an embodiment of the present invention is characterized in that an inter-particle distance is 200 nm or more and 600 nm or less and a coefficient of variation thereof is 1.2 or less. Since the inter-particle distance of the CB is in the above-described range, the optimum volume resistance as the electrically conductive layer can be maintained, and a conductive path having extremely low resistance or an insulating region in which electricity hardly flows is not formed by the small coefficient of variation. Thus, electricity does not flow locally but can flow entirely. That is, the conductive path by the conductive particles in the insulating resin, that is, a general percolation hardly occurs, in which a conductive part and a non-conductive part are formed microscopically and electrical conductivity exhibits macroscopically. In the electrically conductive layer according to an embodiment of the present invention, the volume resistance value of the electrically conductive layer is decreased by increasing a ratio of the electrically conductive agent while filling conductive particles in the resin so as not to form the conductive path as much as possible. That is, it is considered that local electric field concentration that can deteriorate the photosensitive layer does not occur well, and the leak resistance is improved.

Further, the number average primary particle diameter of the CB according to an embodiment of the present invention is characterized by being 200 nm or more and 500 nm or less. It is considered that since the number average primary particle diameter of the CB is in this range, a conductive part having a low resistance locally is not formed, but an electrically conductive layer having a sufficiently low film resistance can be obtained, thereby avoiding the local electric field concentration, leading to improvement in the leak resistance. That is, as described below, it is considered that it is difficult to avoid the local electric field concentration even if the number average primary particle diameter of the CB is excessively large or excessively small.

The electrically conductive layer generally has a thickness of about several micrometers to about several tens of micrometers. If the number average primary particle diameter of the CB relative to the thickness of the electrically conductive layer is excessively large, resistance unevenness of the electrically conductive layer becomes large, and the electric field concentration easily occurs. That is, it is difficult to precisely arrange conductive particles over the entire region of the electrically conductive layer, and therefore, agglomeration of the conductive particles necessarily occurs. When the number average primary particle diameter of the CB is large, since a size of the agglomerate mass is about the same as the thickness of the electrically conductive layer, the electric field is concentrated at that portion.

Meanwhile, it is known that when the number average primary particle diameter of the CB is small, the CB structure (aggregate of primary particles) generally develops, and in this case, the above-described SF-1 becomes large, and thus the electric field concentration easily occurs.

Further, even though it is practically difficult to be performed, it is considered that even when a CB having a small particle diameter in which the structure is not developed is used, it is difficult to avoid the electric field concentration due to the following reason. That is, since there are a number of surface functional groups on the surface of the CB, a boundary between the resin and CB has an interface resistance. When the electrically conductive layer is designed to have the above-described film thickness, if the number average primary particle diameter of the CB is controlled to be small, the interface between CB and resin increases, and thus the volume resistance of the electrically conductive layer becomes large. Therefore, in order to set an optimum volume resistance value as the electrically conductive layer without forming the conductive part by the CB, it is necessary to increase an amount of the CB added to the electrically conductive layer by that amount. Therefore, the CB in the electrically conductive layer becomes dense, and a conductive path by the CB in the electrically conductive layer easily occurs, and thus the electric field concentration occurs. In addition, a change of the volume resistance of the electrically conductive layer with respect to a small change in the CB dispersion or the content is also large, and thus the control is substantially difficult to be conducted.

As in the mechanism estimated above, each constitution has a synergistic effect to each other, and thus it is possible to achieve an effect of the present invention.

[Electrophotographic Photosensitive Member]

An electrophotographic photosensitive member according to an embodiment of the present invention includes: a support; an electrically conductive layer; and a photosensitive layer.

A method for manufacturing an electrophotographic photosensitive member can include a method of preparing a coating liquid for each layer to be described below, and coating the coating liquid in a desired layer order, followed by drying. Here, examples of an application method of the coating liquid can include dip coating, spray coating, ink jet coating, roll coating, die coating, blade coating, curtain coating, wire bar coating, and ring coating, and the like. Among them, dip coating is preferable in view of efficiency and productivity.

Hereinafter, the support and each layer of the electrophotographic photosensitive member are described.

<Support>

In the present invention, the electrophotographic photosensitive member has a support. Further, the support is preferably an electrically conductive support having electrical conductivity. Examples of a shape of the support can include a cylindrical shape, a belt shape, a sheet shape, and the like. Among them, the cylindrical shape is preferable. In addition, a surface of the support may be subjected to electrochemical treatment such as positive electrode oxidation, or blast treatment, centerless grinding process, cutting treatment, or the like.

As a material of the support, a metal, a resin, glass, or the like is preferable.

Examples of the metal can include aluminum, iron, nickel, copper, gold, stainless steel, an alloy thereof, or the like. Among them, an aluminum support obtained by using aluminum is preferable.

In addition, electrical conductivity may be imparted to the resin or glass by treatment such as mixing or coating, or the like, of an electrically conductive material.

<Electrically Conductive Layer>

In the present invention, an electrically conductive layer is provided on the support. By providing the electrically conductive layer, scratches or irregularities on a surface of the support can be concealed, or reflection of light on the surface of the support can be controlled. The electrically conductive layer contains CB; and a binder resin.

A detailed measurement method of SF-1 is described later, but measurement of SF-1 is performed on the CB by observation of a cross section of the electrically conductive layer. The SF-1 is measured by considering the CBs that are agglomerated and in contact on the cross section as one lump. In the CB, the SF-1 in the electrically conductive layer needs to be 150 or less, but a CB shape needs to be a roughly spherical shape but does not need to be agglomerated, that is, the structure needs to be underdeveloped. Therefore, a DBP oil adsorption of the CB is preferably 45 $cm^3$/100 g or less, more preferably 40 $cm^3$/100 g or less.

In addition, although not particularly limited, since there is little development of structure, it is preferable to use a thermal black manufactured by a thermal method that does not make a conductive path as described above, particularly a medium thermal (MT carbon).

Further, if there are large impurities included in the CB or surface functional groups on the CB surface, resistance at an interface between the binder resin and the CB becomes large. Accordingly, in order to obtain a volume resistance value required as the electrically conductive layer, it is necessary to enlarge a charging amount of the CB, and as a result, the CBs tend to agglomerate and the leak resistance is deteriorated. Further, since the resistance of the CB interface increases, in an electrophotographic process, electrons generated when light is irradiated on the photosensitive layer does not flow smoothly to the support, and thus potential stability of the bright part at the time of long-term use is deteriorated. Thus, an ash content of the CB is preferably 0.1% or less, more preferably 0.05% or less. In addition, pH of the CB is preferably 6.0 or more, more preferably 9.0 or more.

A number average primary particle diameter (Di) of the CB used in the electrically conductive layer is required to be 200 nm or more and 500 nm or less.

As described above, the number average primary particle diameter of the CB in the electrically conductive layer is required to be 200 nm or more and 500 nm or less. To this end, the number average primary particle diameter (Di) of the CB used in the electrically conductive layer is required to be in the above-described range.

The electrically conductive layer preferably contains the CB at a ratio of 15% by volume or more and 35% by volume or less relative to the total volume of the electrically conductive layer.

By controlling the content of the CB in the electrically conductive layer to 15% by volume or more relative to the total volume of the electrically conductive layer, a dispersion degree of the CB is lowered, and thus there is no need to make an attempt at low resistance by formation of a conductive path by lowering a dispersion degree of the CB, and a desired low resistance film as an electrically conductive layer can be formed. Therefore, concentration of local electric field intensity by the conductive path can be avoided, and thus the leak resistance can be maintained.

In addition, by controlling the content of CB in the electrically conductive layer to be 35% by volume or less relative to the total volume of the electrically conductive layer, contact between the CB particles can be avoided and the concentration of local electric field intensity by the conductive path can be inevitably avoided, thereby maintaining leak resistance.

The electrically conductive layer preferably contains the CB at a ratio of 25% by volume or more and 30% by volume or less relative to the total volume of the electrically conductive layer.

The electrically conductive layer may further include other conductive particles.

The other conductive particles can be formed of a metal oxide or a metal.

Examples of the metal oxide can include zinc oxide, aluminum oxide, indium oxide, silicon oxide, zirconium oxide, tin oxide, titanium oxide, magnesium oxide, antimony oxide, bismuth oxide, and the like. Examples of the metal can include aluminum, nickel, iron, nichrome, copper, zinc, silver, and the like. When the metal oxide is used as the other conductive particle, a surface of the metal oxide may be treated with a silane coupling agent, or the like, or the metal oxide may be doped with an element such as phosphorus, aluminum, or the like, or an oxide thereof.

Further, the other conductive particle may have a laminated constitution having a core particle and a coating that coats the particle. Examples of the core particle can include titanium oxide, barium sulfate, zinc oxide, and the like. The coating can include a metal oxide such as tin oxide, or the like.

The binder resin preferably has a dissolution parameter (SP value) of 18.0 $MPa^{1/2}$ or more and 25.0 $MPa^{1/2}$ or less. The dissolution parameter (SP value) is used as an index indicating polarity of the resin, and generally the polarity is large as the SP value is large. The CB has high dispersibility with respect to a resin having a large polarity in some degree, and has good compatibility with a resin having the SP value within the above-described range, and thus an agglomerate mass in which an electric field is concentrated in the electrically conductive layer is not formed well.

As the binder resin, a polyurethane resin (SP value: 20.4 $MPa^{1/2}$) or a phenol resin (SP value: 23.1 $MPa^{1/2}$) is particularly preferable.

In addition, the electrically conductive layer may further contain silicone oil, resin particles, and the like.

An average film thickness of the electrically conductive layer is preferably 3.0 μm or more and 50 μm or less, more preferably 5 μm or more and 40 μm or less, and particularly preferably 10 μm or more and 35 μm or less.

The electrically conductive layer can be formed by preparing a coating liquid for an electrically conductive layer containing each of the above-described materials and a solvent, and forming a coating film, followed by drying. Examples of the solvent used in the coating liquid can include an alcohol-based solvent, a sulfoxide-based solvent, a ketone-based solvent, an ether-based solvent, an ester-based solvent, an aromatic hydrocarbon-based solvent, and the like. Examples of a dispersion method for dispersing conductive particles in the coating liquid for an electrically conductive layer can include a method using a paint shaker, a sand mill, a ball mill, and a liquid collision type high speed dispersion machine.

The electrically conductive layer preferably has a volume resistivity of $10^5\Omega\cdot$cm or more and $10^{12}\Omega\cdot$cm or less. When the volume resistivity of the electrically conductive layer is $10^{12}\Omega\cdot$cm or less, a flow of charges is not easily stagnant at the time of image formation, and thus residual potential does not increase well, and as a result, variations in the dark part potential and the bright part potential hardly occur. On the other hand, when the volume resistivity of the electrically conductive layer is $10^5\Omega\cdot$cm or more, an amount of charge locally flowing in the electrically conductive layer at the time of charging of the electrophotographic photosensitive member can be suppressed, and thus the leak hardly occurs.

The electrically conductive layer more preferably has a volume resistivity of $10^6\Omega\cdot$cm or more and $10^{10}\Omega\cdot$cm or less.

Figure 3:
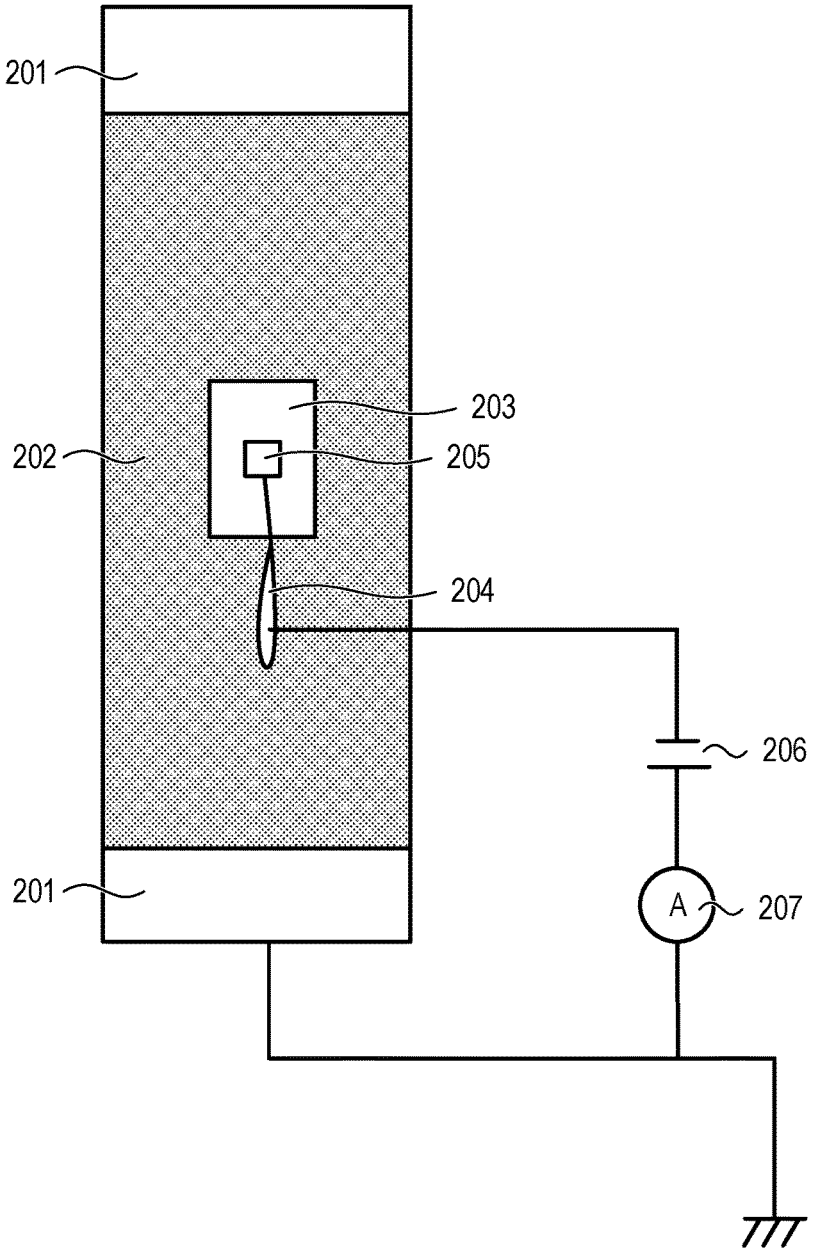
FIG. 3 is a top view for explaining a method of measuring a volume resistivity of an electrically conductive layer.
Figure 4:
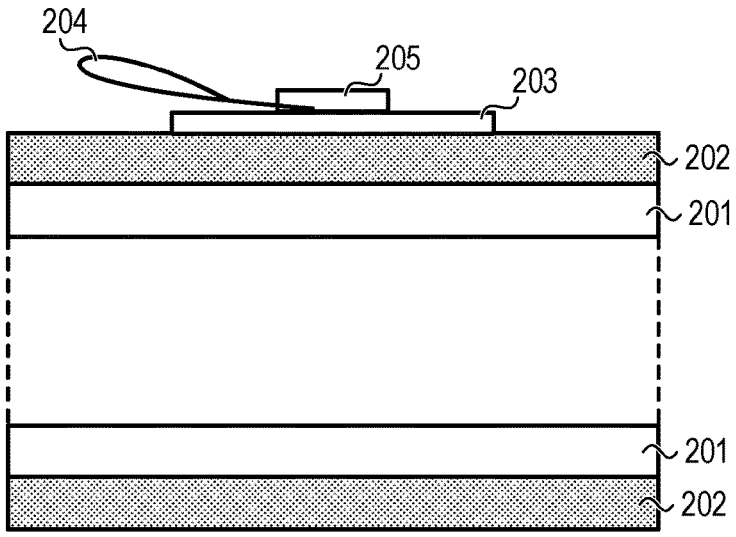
FIG. 4 is a cross-sectional view for explaining a method of measuring a volume resistivity of an electrically conductive layer.

A method of measuring the volume resistivity of the electrically conductive layer of the electrophotographic photosensitive member is described with reference to FIGS. 3 and 4. FIG. 3 is a top view for explaining a method of measuring a volume resistivity of the electrically conductive layer, and FIG. 4 is a cross-sectional view for explaining the method of measuring the volume resistivity of the electrically conductive layer.

The volume resistivity of the electrically conductive layer is measured under an environment of normal temperature and normal humidity (23° C./50% RH). A tape 203 made of copper (product No. 1181 manufactured by Sumitomo 3M Ltd.) is attached to a surface of an electrically conductive layer 202, and is used as a surface side electrode of the electrically conductive layer 202. Further, the support 201 is used as a back side electrode of the electrically conductive layer 202. A power source 206 for applying a voltage between the tape 203 made of copper and the support 201, and a current measuring device 207 for measuring a current flowing between the tape 203 made of copper and the support 201 are installed. Further, in order to apply the voltage to the tape 203 made of copper, a copper wire 204 is placed on the tape 203 made of copper. A tape 205 made of copper for fixing a copper wire that is the same as the tape 203 made of copper is attached from the above of the copper wire 204 so that the copper wire 204 does not protrude from the tape 203 made of copper, and the copper wire 204 is fixed to the tape 203 made of copper. A voltage is applied to the tape 203 made of copper using the copper wire 204.

A background current value when no voltage is applied between the tape 203 made of copper and the support 201 is $I_0$[A], and a current value when only a direct current voltage (direct current component) of −1V is applied is I [A]. In addition, a film thickness of the electrically conductive layer 202 is d [cm] and an area of the electrode (tape 203 made of copper) on a surface side of the electrically conductive layer 202 is S [$cm^2$]. At this time, a value represented by the following equation (1) is a volume resistivity ρ[Ω·cm] of the electrically conductive layer 202.

$$\rho=1/(I-I_0)\times S/d[\Omega\cdot cm] \quad (1)$$

In this measurement, it is preferable to use a device capable of measuring a minute current as the current measuring device 207 in order to measure a minute current amount of $1\times10^{-6}$ A or less in an absolute value. As the device, for example, a pA meter (product name: 4140 B, manufactured by Yokogawa Hewlett-Packard Japan, Ltd.), or the like, can be used.

In addition, even though the volume resistivity of the electrically conductive layer is measured in a state in which only the electrically conductive layer is formed on the support, or measured in a state in which each layer (photosensitive layer, and the like) on the electrically conductive layer is peeled from the electrophotographic photosensitive member to leave only the electrically conductive layer on the support, the same value is obtained.

<Undercoat Layer>

In the present invention, an undercoat layer may be provided on the electrically conductive layer. By providing the undercoat layer, an adhesion function between layers can be enhanced to provide a charge injection blocking function.

The undercoat layer preferably contains a resin. In addition, the undercoat layer may be formed as a cured film by polymerizing a composition containing a monomer having a polymerizable functional group.

Examples of the resin can include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamide acid resin, a polyimide resin, a polyamideimide resin, a cellulose resin, and the like.

Examples of the polymerizable functional group of the monomer having a polymerizable functional group can include an isocyanate group, a block isocyanate group, a methylol group, an alkylated methylol group, an epoxy group, a metal alkoxide group, a hydroxyl group, an amino group, a carboxyl group, a thiol group, a carboxylic acid anhydride group, a carbon-carbon double bond group, and the like.

In addition, the undercoat layer may further contain an electron transporting material, a metal oxide, a metal, a conductive polymer, and the like, for the purpose of increasing electrical characteristics. Among them, the electron transporting material and the metal oxide are preferably used.

Examples of the electron transporting material can include a quinone compound, an imide compound, a benzoimidazole compound, a cyclopentadienylidene compound, a fluorenone compound, a xanthone compound, a benzophenone compound, a cyanovinyl compound, a halogenated aryl compound, a silole compound, a boron-containing compound, and the like. The undercoat layer may be formed as a cured film by using an electron transporting material having a polymerizable functional group as an electron transporting material, and copolymerizing with an above-described monomer having a polymerizable functional group.

Examples of the metal oxide can include indium tin oxide, tin oxide, indium oxide, titanium oxide, zinc oxide, aluminum oxide, silicon dioxide, and the like. Examples of the metal can include gold, silver, aluminum, and the like.

Further, the undercoat layer may further contain an additive.

An average film thickness of the undercoat layer is preferably 0.1 μm or more and 50 μm or less, more preferably 0.2 μm or more and 40 μm or less, and particularly preferably 0.3 μm or more and 30 μm or less.

The undercoat layer can be formed by preparing a coating liquid for an undercoat layer containing each of the above-described materials and a solvent, and forming the coating film, followed by drying and/or curing. Examples of the solvent used for the coating liquid can include an alcohol-based solvent, a ketone-based solvent, an ether-based solvent, an ester-based solvent, and an aromatic hydrocarbon-based solvent, and the like.

<Photosensitive Layer>

A photosensitive layer of an electrophotographic photosensitive member is mainly classified into (1) a laminate type photosensitive layer and (2) a monolayer type photosensitive layer. The laminate type photosensitive layer (1) includes: a charge generation layer containing a charge generating material; and a charge transport layer containing a charge transporting material. The monolayer type photosensitive layer (2) includes a photosensitive layer containing both a charge generating material and a charge transporting material.

(1) Laminate Type Photosensitive Layer

The laminate type photosensitive layer includes a charge generation layer; and a charge transport layer.

(1-1) Charge Generation Layer

The charge generation layer preferably contains a charge generating material; and a resin.

Examples of the charge generating material can include an azo pigment, a perylene pigment, a polycyclic quinone pigment, an indigo pigment, and a phthalocyanine pigment, and the like. Among them, the azo pigment and the phthalocyanine pigment are preferable. Among the phthalocyanine pigments, an oxytitanium phthalocyanine pigment, a chlorogallium phthalocyanine pigment, and a hydroxygallium phthalocyanine pigment are preferable.

A content of the charge generating material in the charge generation layer is preferably 40 mass % or more and 85 mass % or less, more preferably 60 mass % or more and 80 mass % or less, relative to the total mass of the charge generation layer.

Examples of the resin can include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, a polyvinyl chloride resin, and the like. Among them, the polyvinyl butyral resin is more preferable.

In addition, the charge generation layer may further contain an additive such as an antioxidant, an ultraviolet absorber, or the like. Specific examples thereof can include a hindered phenol compound, a hindered amine compound, a sulfur compound, a phosphorus compound, and a benzophenone compound, and the like.

An average film thickness of the charge generation layer is preferably 0.1 μm or more and 1 μm or less, and more preferably 0.15 μm or more and 0.4 μm or less.

The charge generation layer can be formed by preparing a coating liquid for a charge generation layer containing each of the above-described materials and a solvent, and forming a coating film, followed by drying. Examples of the solvent used in the coating liquid can include an alcohol-based solvent, a sulfoxide-based solvent, a ketone-based solvent, an ether-based solvent, an ester-based solvent, an aromatic hydrocarbon-based solvent, and the like.

(1-2) Charge Transport Layer

The charge transport layer preferably contains a charge transporting material; and a resin.

Examples of the charge transporting material can include a polycyclic aromatic compound, a heterocyclic compound, a hydrazone compound, a styryl compound, an enamine compound, a benzidine compound, a triarylamine compound, and a resin having a group derived from these materials, and the like. Among them, the triarylamine compound and the benzidine compound are preferable.

A content of the charge transporting material in the charge transport layer is preferably 25 mass % or more and 70 mass % or less, more preferably 30 mass % or more and 55 mass % or less, relative to the total mass of the charge transport layer.

Examples of the resin can include a polyester resin, a polycarbonate resin, an acrylic resin, and a polystyrene resin, and the like. Among them, the polycarbonate resin and the polyester resin are preferable. As the polyester resin, a polyarylate resin is particularly preferable.

A content ratio (mass ratio) of the charge transporting material to the resin is preferably 4:10 to 20:10, and more preferably 5:10 to 12:10.

In addition, the charge transport layer may contain an additive such as an antioxidant, an ultraviolet absorber, a plasticizer, a leveling agent, a lubricity imparting agent, and an abrasion resistance improving agent, or the like. Specific examples of the charge transport layer can include a hindered phenol compound, a hindered amine compound, a sulfur compound, a phosphorus compound, a benzophenone compound, a siloxane modified resin, silicone oil, a fluororesin particle, a polystyrene resin particle, a polyethylene resin particle, a silica particle, an alumina particle, a boron nitride particle, and the like.

An average film thickness of the charge transport layer is preferably 5 μm or more and 50 μm or less, more preferably 8 μm or more and 40 μm or less, and particularly preferably 9 μm or more and 30 μm or less.

The charge transport layer can be formed by preparing a coating liquid for a charge transport layer containing each of the above-described materials and a solvent, and forming a coating film, followed by drying. Examples of the solvent used for the coating liquid can include an alcohol-based solvent, a ketone-based solvent, an ether-based solvent, an ester-based solvent, and an aromatic hydrocarbon-based solvent, and the like. Among these solvents, the ether-based solvent or the aromatic hydrocarbon-based solvent is preferable.

(2) Monolayer Type Photosensitive Layer

A monolayer type photosensitive layer can be formed by preparing a coating liquid for a photosensitive layer containing a charge generating material, a charge transporting material, a resin and a solvent, and forming a coating film, followed by drying. The charge generating material, the charge transporting material, and the resin are the same as the examples of the material in the above-described [(1) laminate type photosensitive layer].

<Protection Layer>

In the present invention, a protection layer may be provided on the photosensitive layer. By providing the protection layer, durability can be improved.

The protection layer preferably contains a conductive particle and/or a charge transporting material; and a resin.

Examples of the conductive particle can include particles of metal oxides such as titanium oxide, zinc oxide, tin oxide, indium oxide, and the like.

Examples of the charge transporting material can include a polycyclic aromatic compound, a heterocyclic compound, a hydrazone compound, a styryl compound, an enamine compound, a benzidine compound, a triarylamine compound, and a resin having a group derived from these materials, and the like. Among them, the triarylamine compound and the benzidine compound are preferable.

Examples of the resin can include a polyester resin, an acrylic resin, a phenoxy resin, a polycarbonate resin, a polystyrene resin, a phenol resin, a melamine resin, an epoxy resin, and the like. Among them, the polycarbonate resin, the polyester resin, and the acrylic resin are preferable.

In addition, the protection layer may also be formed as a cured film by polymerizing a composition containing a monomer having a polymerizable functional group. Examples of a reaction at this time can include a thermal polymerization reaction, a photopolymerization reaction, and a radiation polymerization reaction, and the like. Examples of the polymerizable functional group of the monomer having a polymerizable functional group can include an acrylic group, a methacrylic group, and the like. As the monomer having the polymerizable functional group, a material having charge transport ability may be used.

The protection layer may contain an additive such as an antioxidant, an ultraviolet absorber, a plasticizer, a leveling agent, a lubricity imparting agent, and an abrasion resistance improving agent, or the like. Specific examples of the protection layer can include a hindered phenol compound, a hindered amine compound, a sulfur compound, a phosphorus compound, a benzophenone compound, a siloxane modified resin, silicone oil, a fluororesin particle, a polystyrene resin particle, a polyethylene resin particle, a silica particle, an alumina particle, a boron nitride particle, and the like.

An average film thickness of the protection layer is preferably 0.5 μm or more and 10 μm or less, and more preferably 1 μm or more and 7 μm or less.

The protection layer can be formed by preparing a coating liquid for a protection layer containing each of the above-described materials and a solvent, and forming the coating film, followed by drying and/or curing. Examples of the solvent used for the coating liquid can include an alcohol-based solvent, a ketone-based solvent, an ether-based solvent, a sulfoxide-based solvent, an ester-based solvent, and an aromatic hydrocarbon-based solvent.

[Process Cartridge and Electrophotographic Apparatus]

The process cartridge according to another aspect of the present invention is characterized by including: the electrophotographic photosensitive member as described above; and at least one unit that are integrally supported, the at least one unit being selected from the group consisting of a charging unit, a developing unit, a transfer unit, and a cleaning unit, and being detachably attachable to an electrophotographic apparatus main body.

Further, the electrophotographic apparatus according to still another aspect of the present invention is characterized by including the electrophotographic photosensitive member as described above, a charging unit, an exposing unit, a developing unit, and a transfer unit.

Figure 2:
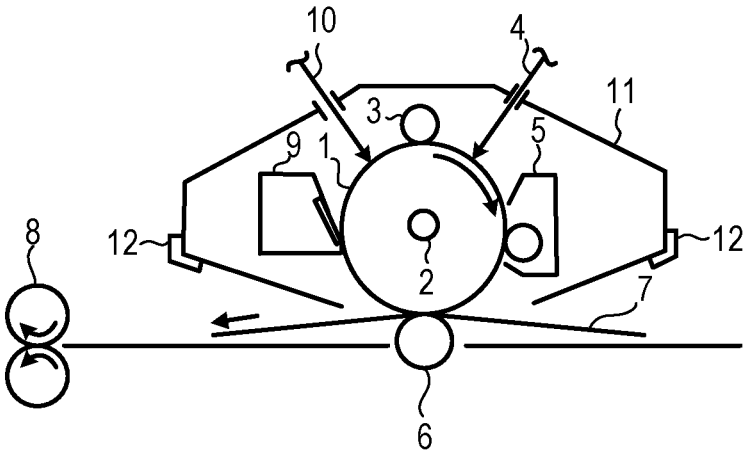
FIG. 2 is a view illustrating an example of a schematic constitution of an electrophotographic apparatus including a process cartridge having an electrophotographic photosensitive member according to an embodiment of the present invention.

FIG. 2 shows an example of schematic constitution of an electrophotographic apparatus including a process cartridge provided with an electrophotographic photosensitive member.

Reference numeral 1 denotes a cylindrical electrophotographic photosensitive member which is rotationally driven on a shaft 2 at a predetermined peripheral speed in a direction of an arrow. A surface of the electrophotographic photosensitive member 1 is charged to a predetermined positive or negative potential by a charging unit 3. In the drawings, a roller charging method by a roller type charging member is shown, but a charging method such as a corona charging method, a proximity charging method, an injection charging method, or the like, may be adopted. A surface of the charged electrophotographic photosensitive member 1 is irradiated with exposure light 4 from an exposing unit (not shown), and an electrostatic latent image corresponding to desired image information is formed. The electrostatic latent image formed on the surface of the electrophotographic photosensitive member 1 is developed by a toner contained in a developing unit 5, and a toner image is formed on the surface of the electrophotographic photosensitive member 1. The toner image formed on the surface of the electrophotographic photosensitive member 1 is transferred to a transfer material 7 by a transfer unit 6. The transfer material 7 onto which the toner image is transferred is conveyed to a fixing unit 8, and is subjected to a toner image fixing process to be printed out of the electrophotographic apparatus. The electrophotographic apparatus may have a cleaning unit 9 for removing an attachment such as the toner remaining on the surface of the electrophotographic photosensitive member 1, or the like, after transfer. Further, a so-called cleanerless system may be used in which the attachment is removed by the developing unit, or the like, without separately providing the cleaning unit. The electrophotographic apparatus may include an electricity eliminating instrument that performs electricity elimination on the surface of the electrophotographic photosensitive member 1 by a pre-exposure light 10 from a pre-exposing unit (not shown). Further, in order to detach and attach the process cartridge 11 according to another aspect of the present invention to an electrophotographic apparatus main body, a guide unit 12 such as a rail, or the like, may be provided.

The electrophotographic photosensitive member according to another aspect of the present invention can be used for a laser beam printer, an LED printer, a copying machine, a facsimile, and a multifunction machine thereof, and the like.

According to an aspect of the present invention, there is provided an electrophotographic photosensitive member capable of achieving both high leak resistance and reduction in variations in dark part potential and bright part potential due to repeated use even when carbon black is used for an electrically conductive layer.

Example

Hereinafter, the present invention is described in more detail with reference to Examples and Comparative Examples. The present invention is not limited by the following Examples unless it goes beyond the gist of the present invention. In addition, in the description of the following Examples, "part" is on a mass basis unless otherwise defined.

Preparation Example 1 of CB

CB (product name: Thermax N990 manufactured by Cancarb Co., Ltd., pH 11.0, ash content 0.05%, DBP oil adsorption 38 $cm^3$/100 g, and number average primary particle diameter 280 nm) was subjected to classification by an Elbow-Jet Air Classifier (product name: EJ-PURO manufactured by Nittetsu Mining Co., Ltd.). As a result, a classified CB particle 1 having a number average primary particle diameter of 480 nm and a classified CB particle 2 having a number average particle diameter of 210 μm were obtained.

Preparation Example 2 of CB

CB (product name: Thermax N907 manufactured by Cancarb Co., Ltd., pH 11.0, ash content 0.08%, DBP oil adsorption 39 $cm^3$/100 g, and number average primary particle diameter 280 nm) was subjected to liquid phase treatment with nitric acid, and thus a surface treated CB particle 1 having pH of 3.5 and an ash content of 0.15% was obtained. The pH of the CB was determined by pH of a pigment washing water, and the pH of the pigment washing water was measured according to JIS K5101-17-1. In addition, the ash content was measured by drying a sample using an electric drier at 105° C. for 2 hours, placing 2 g in a crucible, measuring the residue after roasting at 550° C., and calculating a ratio to the sample before the roasting.

Preparation Example of Coating Liquid for Electrically Conductive Layer

Preparation Example of Coating Liquid 1 for Electrically Conductive Layer

A solution was obtained by dissolving 15 parts of a butyral resin (product name: BM-1 manufactured by Sekisui Chemical Company, Limited) as a polyol resin and 15 parts of a blocked isocyanate resin (product name: TPA-B80E, 80% solution, manufactured by Asahi Kasei Corporation) in a mixed solvent containing 45 parts of methyl ethyl ketone and 85 parts of 1-butanol.

To this solution, 15 parts of carbon black (product name: Thermax N990 manufactured by Cancarb Co., Ltd., pH 11.0, ash content 0.05%, DBP oil adsorption 38 $cm^3$/100 g, and number average primary particle diameter 280 nm) was added. The solution after the CB was added was placed in a vertical type sand mill using 180 parts of glass beads having an average particle diameter of 1.0 mm as a dispersion medium, and subjected to dispersion treatment for 4 hours under conditions of an atmosphere of 23±3° C. and a rotation speed of 1500 rpm (peripheral speed: 5.5 m/s) to obtain a dispersion. Glass beads were removed from the dispersion by a mesh.

To the dispersion from which the glass beads are removed, 0.01 part of silicone oil (product name: SH28 PAINT ADDITIVE manufactured by Dow Corning Toray Co., Ltd.) was added as a leveling agent. Further, at the same time, 5.0 parts of a crosslinked polymethyl methacrylate (PMMA) particle (product name: Techpolymer SSX-102 manufactured by Sekisui Plastics Co., Ltd., average primary particle diameter 2.5 μm) as a surface roughness-imparting agent was added. Then, by stirring, a coating liquid 1 for an electrically conductive layer was prepared.

Preparation Examples of Coating Liquids 2 to 7 and C1 to C3 for Electrically Conductive Layer Coating liquids 2 to 7 and C1 to C3 for an electrically conductive layer were prepared in the same manner as in the preparation of the coating liquid 1 for an electrically conductive layer except that a kind, an amount (number of parts) and a dispersion time of the CB particle used at the time of preparing the coating liquid for an electrically conductive layer were changed as shown in Table 1 below. For coating liquid C3 for electrically conductive layer, CB having pH of 8.0, DBP oil adsorption of 63 $cm^3$/100 g, ash content 0.2%, and average inter-particle distance of 27 nm (product name: #52 manufactured by Mitsubishi Chemical Corporation) was used.

Preparation Example of Coating Liquids 8 to 10 for Electrically Conductive Layer Coating liquids 8 to 10 for an electrically conductive layer were prepared in the same manner as in the preparation of the coating liquid 2 for an electrically conductive layer except that a kind of the CB particle used at the time of preparing the coating liquid for an electrically conductive layer was changed as shown in Table 2 below.

Preparation Example of Coating Liquid 11 for Electrically Conductive Layer

In a sand mill using 420 parts of glass beads having a diameter of 0.8 mm, 168 parts of a phenol resin (product name: Plyophen J-325 manufactured by DIC company, resin solid content 60%, density after curing 1.3 g/$cm^2$) as a binder resin, and 98 parts of 1-methoxy-2-propanol as a solvent, 45 parts of CB (product name: Thermax N990, pH 11.0, ash content 0.05%, DBP oil adsorption 38 $cm^3$/100 g manufactured by Cancarb Co., Ltd.) as an electrically conductive agent were placed, and subjected to dispersion treatment under conditions of a rotation speed of 1500 rpm and a dispersion treatment time of 4 hours, thereby obtaining a dispersion.

Glass beads were removed from the dispersion by a mesh.

To the dispersion from which the glass beads are removed, 13.8 parts of silicone resin particles (product name: Tospearl 120 manufactured by Momentive Performance Materials Inc., average particle diameter 2 μm, and density 1.3 g/$cm^2$) as a surface roughness-imparting agent were added. In addition, at the same time, 0.014 part of silicone oil (product name: SH28PA manufactured by Dow Corning Toray Co., Ltd.) as a leveling agent, 6 parts of methanol, and 6 parts of 1-methoxy-2-propanol were added. Then, by stirring, a coating liquid 11 for an electrically conductive layer was prepared.

TABLE 1

| Coating liquid for electrically conductive layer No. | CB kind | CB added amount (Mass part) | Dispersion time (Time) |
|---|---|---|---|
| 2 | Thermax N990 (manufactured by Cabcarb) | 20 | 10 |
| 3 | Thermax N990 (manufactured by Cabcarb) | 12 | 2 |
| 4 | Thermax N990 (manufactured by Cabcarb) | 15 | 3 |
| 5 | Classified CB1 | 15 | 4 |
| 6 | Thermax N990 (manufactured by Cabcarb) | 22 | 15 |
| 7 | Classified CB2 | 17 | 6 |
| C1 | Surface treated CB1 | 43.5 | 20 |
| C2 | Classified CB2 | 27 | 20 |
| C3 | #52 (manufactured by Mitsubishi Chemical Corporation) | 6 | 20 |

TABLE 2

| Coating liquid for electrically conductive layer No. | CB kind | pH | Ash content (%) | DBP oil adsorption ($cm^3$/100 g) |
|---|---|---|---|---|
| 8 | Thermax N990UP (manufactured by Cabcarb) | 6.1 | 0.003 | 40 |
| 9 | Thermax N907 (manufactured by Cabcarb) | 9.9 | 0.08 | 39 |
| 10 | Thermax N908UP (manufactured by Cabcarb) | 4.5 | 0.006 | 38 |

Production Example of Electrophotographic Photosensitive Member

Production Example of Electrophotographic Photosensitive Member 1

An aluminum cylinder (JIS-A3003, aluminum alloy) having a length of 257 mm and a diameter of 24 mm, manufactured by a manufacturing method including an extrusion process and a drawing process, was used as a support.

The coating liquid 1 for an electrically conductive layer was dipped and coated on the support under an environment of normal temperature and normal humidity (23° C./50% RH), and the obtained coating film was dried and thermally cured at 160° C. for 30 minutes to form an electrically conductive layer having a film thickness of 28 μm.

Then, 4.5 parts of N-methoxymethylated nylon (product name: TORESIN EF-30 T manufactured by Nagase ChemteX Corporation) and 1.5 parts of a copolymerized nylon resin (product name: Amilan CM8000 manufactured by Toray Industries, Inc.) were dissolved in a mixed solvent containing 65 parts of methanol and 30 parts of n-butanol to prepare a coating liquid for an undercoat layer. The coating liquid for an undercoat layer was dipped and coated on the electrically conductive layer, and the obtained coating film was dried at 70° C. for 6 minutes to form an undercoat layer having a film thickness of 0.85 μm.

Then, 10 parts of crystalline type hydroxygallium phthalocyanine crystal (charge generating material) having strong peaks at 7.5°, 9.9°, 16.3°, 18.6°, 25.1° and 28.3° of Bragg angle (2θ±0.2°) at CuKα characteristic X-ray diffraction, 5 parts of polyvinyl butyral (product name: S-LEC BX-1 manufactured by Sekisui Chemical Company, Limited.) and 250 parts of cyclohexanone were placed in a sand mill using glass beads having a diameter of 0.8 mm, and subjected to dispersion treatment under a dispersion treatment time of 3 hours. Subsequently, 250 parts of ethyl acetate was added to prepare a coating liquid for a charge generation layer. The coating liquid for a charge generation layer was dipped and coated on the undercoat layer, and the obtained coating film was dried at 100° C. for 10 minutes to form a charge generation layer having a film thickness of 0.15 μm.

Then, 6.0 parts of an amine compound (charge transporting material) represented by the following Chemical Formula (CT-1), 2.0 parts of an amine compound (charge transporting material) represented by the following Chemical Formula (CT-2), 10 parts of bisphenol Z type polycarbonate (product name: Z400 manufactured by Mitsubishi Engineering-Plastics Corporation), and 0.36 part of a siloxane-modified polycarbonate having a repeating structural unit represented by the following Chemical Formula (B-1) and a repeating structural unit represented by the following Chemical Formula (B-2) and having a terminal structure represented by the following Chemical Formula (B-3) ((B-1): (B-2)=95:5 (molar ratio)) were dissolved in a mixed solvent containing 60 parts of o-xylene/40 parts of dimethoxy methane/2.7 parts of methyl benzoate to prepare a coating liquid for a charge transport layer. The coating liquid for a charge transport layer was dipped and coated on the charge generation layer, and the obtained coating film was dried at 125° C. for 30 minutes to form a charge transport layer having a film thickness of 7.0 μm.

[Chemical Formula 1]

(CT-1)

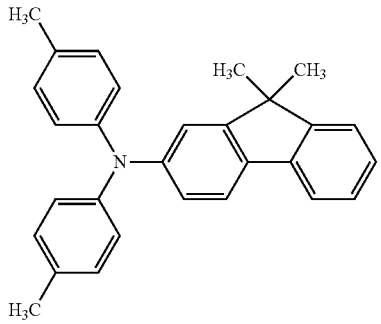

[Chemical Formula 2]

(CT-2)

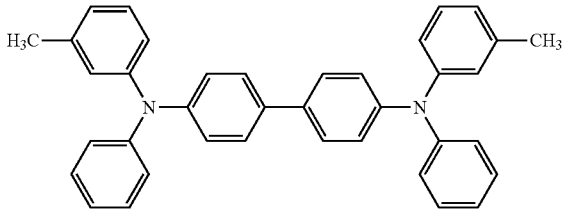

-continued

[Chemical Formula 3]

(B-1)

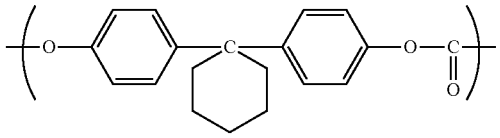

(B-2)

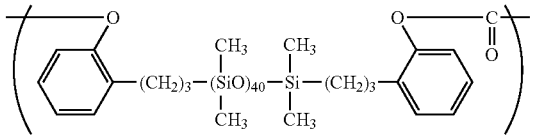

(B-3)

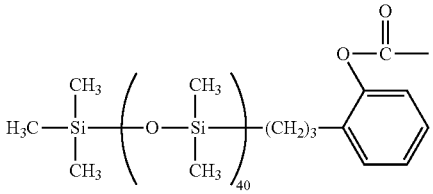

Thus, an electrophotographic photosensitive member 1 in which the charge transport layer was a surface layer was produced. The volume resistivity of the electrically conductive layer of the obtained electrophotographic photosensitive member 1 was measured by the above-described method.

Production Examples of Electrophotographic Photosensitive Members 2 to 11 and C1 to C3

The coating liquid for an electrically conductive layer used in the production of the electrophotographic photosensitive member was changed to each coating liquid for an electrically conductive layer 2 to 11 and C1 to C3 from the coating liquid 1 for an electrically conductive layer. The same method as in the Production Example of the electrophotographic photosensitive member 1 was performed except for the above-described changes, thereby producing electrophotographic photosensitive members 2 to 11 and C1 to C3 in which the charge transport layer was a surface layer. Volume resistivity of the electrically conductive layer was measured in the same manner as in the electrophotographic photosensitive member 1. Results thereof are shown in Table 3 below.

Examples 1 to 11, and Comparative Examples 1 to 3

<Analysis of Electrically Conductive Layer of Electrophotographic Photosensitive Member>

Four pieces cut in 5 mm square were obtained, from respective electrophotographic photosensitive members 1 to 11 and C1 to C3 for analyzing the electrically conductive layer. Then, each piece of the charge transport layer and the charge generation layer was peeled off with chlorobenzene, methyl ethyl ketone, and methanol to expose the electrically conductive layer. Thus, four sample pieces for observation were prepared for each electrophotographic photosensitive member.

For each electrophotographic photosensitive member, each of the four sample pieces was used to perform three-dimensionalization of 2 μm×2 μm×2 μm of the electrically conductive layer by Slice & View of FIB-SEM.

From a contrast difference of the Slice & View of the FIB-SEM, the CB particle can be specified, and a volume of the CB particle and a ratio in the electrically conductive layer can be obtained.

Slice & View conditions were as follows.

Analytical sample processing: FIB method

Processing and observation apparatus: NVision40 manufactured by SII/Zeiss

Slice spacing: 5 nm

Observation condition

Acceleration voltage: 1.0 kV

Sample slope: 54°

WD: 5 mm

Detector: BSE detector

Aperture: 60 μm, high current

ABC: ON

Image resolution: 1.25 nm/pixel

An analysis area is 2 μm in length and 2 μm in width, and information for each cross section is integrated to calculate a volume V per 2 μm in length×2 μm in width×2 μm in thickness ($V_T$=8 $\mu m^3$). In addition, a measurement environment is a temperature of 23° C. and a pressure of $1\times10^{-4}$ Pa.

In addition, as a processing and observation apparatus, Strata400S (sample slope 52°), which is an FEI product, can be used.

The information for each cross section was obtained by image analysis of the specific CB particle region. The image analysis was performed using an image processing software (product name: Image-Pro Plus manufactured by Media Cybernetics, Inc.).

Based on the obtained information, the volume (V [$\mu m^3$]) of the CB particle in a volume of 2 μm×2 μm×2 μm (unit volume 8 $\mu m^3$) was obtained in each of the four sample pieces. Then, (($V[\mu m^3]/8[\mu m^3]$)×100) was calculated. An average value of (($V[\mu m^3]/8[\mu m^3]$)×100) value in the four sample pieces was defined as a content [% by volume] of the CB particle in the electrically conductive layer relative to the total volume of the electrically conductive layer.

Further, in each of the four sample pieces, 100 CB particles included in each sample were arbitrarily selected, and the volume of the CB particle was measured from an FIB-SEM image in which the content of the CB particle was determined. An average primary particle diameter of the CB particle of the sample piece was obtained by defining a radius of a sphere having the same volume as the volume of each CB particle as a particle diameter of the CB particle and calculating an average thereof. The average value of the average primary particle diameter of the CB particle in the four sample pieces was defined as a number average primary particle diameter ($D_1$) of the CB particle in the electrically conductive layer.

Results thereof are shown in Table 3 below.

In addition, 10 cross-sectional images in which the content of the CB particle was determined were arbitrarily selected, and subjected to binarization using image soft so that the CB and others in the electrically conductive layer were clarified. SF-1 represented by Chemical Formula (1) above was calculated for all the CBs in the obtained binarized images, and an average thereof was determined as SF-1 of the electrically conductive layer. As described above, when the CB was agglomerated on the cross section image, the SF-1 was calculated using an aggregate as one conductor. Results thereof are shown in Table 3 below.

Figure 5A:
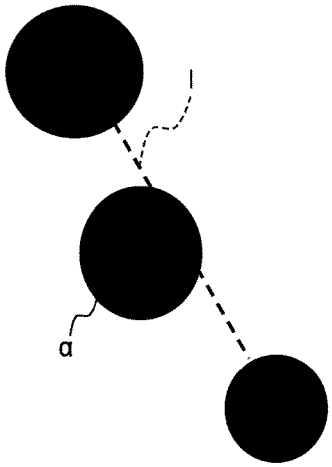
FIG. 5A is a view for explaining a method of calculating an inter-particle distance of carbon black (CB) in the electrically conductive layer when there are other particles on a line segment connecting inter-particles.
Figure 5B:
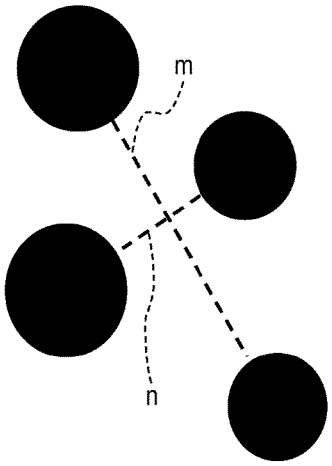
FIG. 5B is a view for explaining a method of calculating an inter-particle distance of the CB in the electrically conductive layer when the line segment connecting the inter-particle intersects the other line segment connecting other particles to each other.

Further, an average inter-particle distance of the CB particle was calculated using the binarized image in which the SF-1 was calculated. A calculation method of the average inter-particle distance is shown below. First, the image was adjusted so that one pixel was 2 nm square. Then, all of the CB particles in the binarized image were connected to each other by the shortest line segments. A method of drawing the shortest line segment was performed by calculating a distance between all the pixels included in each particle of two CB particles to be an object of calculating the inter-particle distance, and by connecting the shortest pixels to each other. When there were many combinations of the shortest pixels, one pixel combination was arbitrarily selected. A length of the shortest line segment was taken as an inter-particle distance between the two CBs, the distance of the combination of all the CBs on the image was measured, and an average thereof was calculated as the average inter-particle distance. However, when there was the other CB particle a on the line segment 1 as shown in FIG. 5A, the line segment was excluded from the average calculation. In addition, when the line segment m intersects the other line segment n connecting other CB particles to each other as shown in FIG. 5B, only a shorter line segment (line segment n in FIG. 5B) was used for the average calculation. In addition, in calculating each inter-particle distance, a primary particle was used as a base, and an inter-particle distance between the CB particles in contact with each other or between the CB particles in the same aggregate was regarded as zero. Results thereof are shown in Table 3 below.

Further, a coefficient of variation of an inter-particle distance was calculated as a value obtained by dividing a standard deviation of a length of a line segment in which the average inter-particle distance was calculated, by the average inter-particle distance. Results thereof are shown in Table 3 below.

TABLE 3

| | Electrophotographic photosensitive member | Volume resistance value/ Ω · cm | CB share/% | Number average primary particle diameter/ nm | SF-1 | Average inter-particle distance/ nm | Coefficient of variation of inter-particle distance |
|---|---|---|---|---|---|---|---|
| Example 1 | 1 | 9.40E+06 | 26.5 | 271 | 128 | 284 | 0.78 |
| Example 2 | 2 | 2.57E+05 | 32.5 | 281 | 141 | 253 | 1.18 |
| Example 3 | 3 | 8.53E+11 | 20.5 | 286 | 135 | 491 | 1.01 |
| Example 4 | 4 | 1.22E+06 | 27.2 | 277 | 133 | 311 | 1.15 |
| Example 5 | 5 | 1.35E+06 | 24.5 | 495 | 138 | 511 | 0.71 |
| Example 6 | 6 | 8.25E+04 | 34.2 | 288 | 148 | 210 | 1.20 |
| Example 7 | 7 | 7.76E+06 | 30.1 | 202 | 121 | 246 | 0.68 |
| Example 8 | 8 | 8.82E+06 | 33.3 | 284 | 142 | 266 | 1.05 |
| Example 9 | 9 | 4.65E+05 | 32.1 | 321 | 138 | 265 | 0.88 |
| Example 10 | 10 | 2.45E+07 | 31.8 | 291 | 137 | 232 | 0.89 |
| Example 11 | 11 | 8.55E+08 | 30.1 | 276 | 132 | 265 | 0.75 |

TABLE 3-continued

| | Electrophotographic photosensitive member | Volume resistance value/ Ω · cm | CB share/% | Number average primary particle diameter/ nm | SF-1 | Average inter-particle distance/ nm | Coefficient of variation of inter-particle distance |
|---|---|---|---|---|---|---|---|
| Comparative Example 1 | C1 | 1.50E+02 | 50.1 | 280 | 211 | 145 | 2.21 |
| Comparative Example 2 | C2 | 6.81E+04 | 41.5 | 198 | 176 | 181 | 1.55 |
| Comparative Example 3 | C3 | 7.09E+06 | 13.5 | 48 | 325 | 122 | 3.02 |

Evaluation (Sheet Passing Durability Test of Electrophotographic Photosensitive Member)

The electrophotographic photosensitive members 1 to 11 and C1 to C3 for sheet passing durability test were mounted on a laser beam printer (product name: HP Laserjet P1505 manufactured by Hewlett Packard Company), and subjected to a sheet passing durability test under an environment of low temperature and low humidity (15° C./10% RH), and images were evaluated. In the sheet passing durability test, 3,000 images were output by print operation performed in an intermittent mode in which character images having a printing rate of 2% were printed one by one in a letter.

Then, one sheet of image evaluation sample (halftone image of one-dot keima (knight of Japanese chess) patterns) was output when starting the sheet passing durability test and after completion of output of 1,500 images and after completion of output of 3,000 images.

The criteria for evaluation of images are as follows. Results thereof are shown in Table 4 below.

A: No leak occurs at all.

B: The leak is slightly observed as a small black spot.

C: The leak is clearly observed as a large black spot.

D: The leak is observed as a large black spot and a short horizontal black line.

E: The leak is observed as a long horizontal black line.

(Static Leak Test of Electrophotographic Photosensitive Member)

The electrophotographic photosensitive members 1 to 11 and C1 to C3 for the static leak test were prepared, and the static leak test was performed as follows.

FIG. 1 shows a static leak test apparatus. The static leak test was performed under an environment of normal temperature and normal humidity (23° C./50% RH). Both ends of the electrophotographic photosensitive member 1 were placed on a fixing table 13 and fixed so as not to move. A portion 14 in contact with the support of the electrophotographic photosensitive member 1 was connected to the ground via reference resistor 15 with 100 kΩ. A φ6 stepped core bar 16 having a φ 20 stepped portion 16*a* in a width of 50 mm was pressed at one end by 5N so that the stepped portion 16*a* contacts a central portion of the photosensitive layer 17 of the electrophotographic photosensitive member 1. A power source 18 for applying a voltage is connected to the stepped core bar 16. A voltage of −3 kV was applied to the stepped core bar 16 and a time (leak resistance time) from when the voltage was applied until the photosensitive layer was leaked, was measured. Further, the leak was judged by monitoring the voltage applied to the reference resistor 15 with 100 kΩ connected to the ground. Results thereof are shown in Table 4 below.

The test was performed with an upper limit of 30 minutes (1800 seconds), and a case in which the leak did not occur for 30 minutes was marked as >1800 in Table 4.

(Evaluation of Suppression Effect of Variation in Bright Part Potential at the Time of Repeated Use)

Each electrophotographic photosensitive member as manufactured above was mounted to a laser beam printer Color Laser Jet Enterprise M552 manufactured by Hewlett Packard Company, and a sheet passing durability test was performed under an environment of a temperature of 23° C./relative humidity of 50%. In the sheet passing durability test, 5,000 images were output by print operation performed in an intermittent mode in which character images having a printing rate of 2% were printed one by one in a letter. Then, a potential (bright part potential) at the time of exposure was measured when starting the sheet passing durability test and after completion of output of 5,000 images. The potential was measured by using one white solid image. The bright part potential at the beginning (when starting the sheet passing durability test) was V1, and the bright part potential after completion of output of 5,000 images was V1'. Then, a bright part potential variation amount $\Delta V1(=|V1'|-|V1|)$ which is a difference between the bright part potential after completion of output of 5,000 images V1' and the bright part potential at the beginning V1, was obtained, respectively. Results thereof are shown in Table 4 below.

TABLE 4

| | Electro-photographic photosensitive member | Sheet passing durability test | static leak test/sec | Bright part potential variation/V |
|---|---|---|---|---|
| Example 1 | 1 | A | >1800 | 15 |
| Example 2 | 2 | A | 1221 | 12 |
| Example 3 | 3 | A | >1800 | 10 |
| Example 4 | 4 | A | 1543 | 12 |
| Example 5 | 5 | A | 1354 | 19 |
| Example 6 | 6 | A | 1024 | 9 |
| Example 7 | 7 | A | >1800 | 16 |
| Example 8 | 8 | A | >1800 | 14 |
| Example 9 | 9 | A | 981 | 17 |
| Example 10 | 10 | A | 1405 | 22 |
| Example 11 | 11 | A | >1800 | 20 |
| Comparative Example 1 | C1 | E | 22 | 33 |
| Comparative Example 2 | C2 | A | 781 | 9 |
| Comparative Example 3 | C3 | E | 7 | 22 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-111664, filed on Jun. 6, 2017 which is hereby incorporated by reference herein in its entirety.

What is claimed is:

1. An electrophotographic photosensitive member comprising:

a support, an electrically conductive layer, and a photosensitive layer, sequentially, wherein the electrically conductive layer contains a binder resin and a carbon black, a number average primary particle diameter of the carbon black is 200 nm or more and 500 nm or less, an average inter-particle distance of the carbon black is 200 nm or more and 600 nm or less, a coefficient of variation of an inter-particle distance is 1.2 or less, and SF-1 of the carbon black is 150 or less.

2. The electrophotographic photosensitive member according to claim 1, wherein the electrically conductive layer has a volume resistivity of $10^5\Omega\cdot$cm or more and $10^{12}\Omega\cdot$cm or less.

3. The electrophotographic photosensitive member according to claim 1, wherein a content of the carbon black in the electrically conductive layer is 15% by volume or more and 35% by volume or less relative to total volume of the electrically conductive layer.

4. The electrophotographic photosensitive member according to claim 1, wherein the carbon black has a DBP oil adsorption of 45 $cm^3$/100 g or less.

5. The electrophotographic photosensitive member according to claim 1, wherein the binder resin has a SP value of 18.0 $MPa^{1/2}$ or more and 25.0 $MPa^{1/2}$ or less.

6. A process cartridge being detachably attachable to an electrophotographic apparatus main body, the process cartridge comprising:

an electrophotographic photosensitive member; and at least one unit that are integrally supported, the at least one unit being selected from the group consisting of a charging unit, a developing unit, a transfer unit, and a cleaning unit, wherein the electrophotographic photosensitive member includes a support, an electrically conductive layer, and a photosensitive layer, sequentially, the electrically conductive layer contains a binder resin and a carbon black, a number average primary particle diameter of the carbon black is 200 nm or more and 500 nm or less, an average inter-particle distance of the carbon black is 200 nm or more and 600 nm or less, a coefficient of variation of an inter-particle distance is 1.2 or less, and SF-1 of the carbon black is 150 or less.

7. An electrophotographic apparatus comprising:

an electrophotographic photosensitive member, a charging unit, an exposing unit, a developing unit, and a transfer unit, wherein the electrophotographic photosensitive member includes a support, an electrically conductive layer, and a photosensitive layer, sequentially, the electrically conductive layer contains a binder resin and a carbon black, a number average primary particle diameter of the carbon black is 200 nm or more and 500 nm or less, an average inter-particle distance of the carbon black is 200 nm or more and 600 nm or less, a coefficient of variation of an inter-particle distance is 1.2 or less, and SF-1 of the carbon black is 150 or less.

* * * * *